US005229825A

United States Patent [19]

Yousey et al.

[11] Patent Number: 5,229,825

[45] Date of Patent: Jul. 20, 1993

[54] MAGNETIC BRUSH LAYDOWN/PICKUP APPARATUS

[75] Inventors: Kevin E. Yousey, Brockport; Dennis R. Kamp, Spencerport; William May, Rochester; Ronald T. Speziale, Rochester; James R. Flick, Rochester, all of N.Y.

[73] Assignee: Eastman Kodak Company, Rochester, N.Y.

[21] Appl. No.: 801,298

[22] Filed: Dec. 2, 1991

[51] Int. Cl.[5] ..... G03G 15/06

[52] U.S. Cl. ..... 355/270; 355/305; 355/253

[58] Field of Search ..... 355/251, 253, 270, 305, 355/306, 303, 302, 296, 301; 118/652, 656, 657, 658; 430/122, 125

[56] References Cited

U.S. PATENT DOCUMENTS

| | | | |
|---|---|---|---|
| 2,874,063 | 2/1959 | Greig | 355/296 X |
| 3,637,306 | 1/1972 | Cooper | 355/305 |
| 3,647,293 | 3/1972 | Queener | 355/305 |
| 3,918,808 | 11/1975 | Narita | 355/297 |
| 4,053,218 | 10/1977 | Mikolas | 355/269 |
| 4,142,165 | 2/1979 | Miyakawa | 118/652 X |
| 4,154,522 | 5/1979 | Ikesue | 355/297 |
| 4,267,245 | 5/1981 | Wada | 355/251 X |
| 4,320,958 | 3/1982 | Fantuzzo | 355/270 |
| 4,422,405 | 12/1983 | Kasahara et al. | 118/658 |
| 4,466,379 | 8/1984 | Nishimura | 118/658 |
| 4,477,174 | 10/1984 | Haneda et al. | 355/253 |
| 4,488,802 | 12/1984 | Sunaga | 355/270 |
| 4,547,064 | 10/1985 | Ammenheuser et al. | 355/298 |
| 4,624,559 | 11/1986 | Haneda et al. | 355/253 |
| 4,664,504 | 5/1987 | Oda et al. | 355/297 |
| 4,727,395 | 2/1988 | Oda et al. | 355/269 X |
| 4,885,223 | 12/1989 | Enoki et al. | 118/652 X |

FOREIGN PATENT DOCUMENTS

| | | | |
|---|---|---|---|
| 0079275 | 5/1983 | Japan | 355/305 |
| 0130365 | 8/1983 | Japan | 355/302 |

*Primary Examiner*—A. T. Grimley
*Assistant Examiner*—Robert Beatty
*Attorney, Agent, or Firm*—David A. Howley

[57] ABSTRACT

In accordance with the invention, there is provided a magnetic brush laydown/pickup apparatus having a shell surrounding a plurality of alternating pole magnets, said shell and magnets being relatively movable to transport developer mix through a development zone. Developer mix, comprised of toner particles and carrier particles, is selectively supplied to the surface of the shell at a location upstream of a development zone. The developer mix is selectively removed from the surface of the shell at a location downstream of the development zone. Toner particles are selectively stripped from the developer mix on the shell. A control is used to (1) activate the supply and removal of developer mix to and from the shell and deactivate the stripping of toner particles to provide a source of toner particles for laydown in the development zone, and (2) deactivate the supply and removal of developer mix to and from the shell and activate the stripping of toner particles to provide a source of developer mix, substantially depleted of toner particles, for toner particle pickup in the development zone.

11 Claims, 3 Drawing Sheets

MAGNETIC BRUSH LAYDOWN/PICKUP APPARATUS

TECHNICAL FIELD OF THE INVENTION

The present invention relates, in general, to the field of electrophotography and, more particularly, to a magnetic brush laydown/pickup apparatus for an electrophotographic copier. It is also applicable in other printer/copier systems in which toner particles are deposited onto a surface and later removed from the surface.

BACKGROUND ART

In a typical electrostatic image reproduction machine, a photoconductive member is electrostatically charged and radiated with a light image corresponding to original information to form an electrostatic latent image on the member through localized photoconduction. A development station applies toner (pigmented marking particles) to the member to create a toned image which is transferred and fixed to a receiver sheet to provide a permanent reproduction. A cleaning station then cleans off any residual toner substance from the member in preparation for another copying operation.

Commonly assigned, copending U.S. patent application Ser. No. 621,691, filed on Nov. 30, 1990, in the names of DeBoer et al, now abandoned, discloses another type of image reproduction machine in which a uniform layer of toner particles is applied to a receiver sheet having a thermoplastic outer layer. The receiver sheet is then imagewise exposed by a laser to soften the thermoplastic layer in exposed areas. Toner particles adjacent the softened areas migrate into the thermoplastic layer under the influence of an electrostatic attraction of the particles to the receiver sheet. After laser exposure is complete, the thermoplastic layer cools, adhering the migrated toner particles to the layer. The toner particles which did not migrate into the thermoplastic layer are then removed by a magnetic brush cleaner. This leaves a toned image in/on the receiver sheet. The image is fused with heat to permanently fix it to the receiver sheet. In this process a large quantity of toner particles must be removed from the receiver sheet to create the toner image.

As far back as 1959, it was asserted by Greig, in U.S. Pat. No. 2,874,063, that developer mix, comprised of toner and magnetic carrier particles, used to develop an electrostatic latent image could, if substantially depleted of toner particles, be used to clean a photoconductive surface of residual toner. This suggests that one apparatus could be used for both development and cleaning.

In U.S. Pat. No. 4,142,165, issued Feb. 27, 1979, in the names of Miyakawa et al, a magnetic brush is disclosed which both develops electrostatic latent images with toner and cleans residual toner. A magnetic brush, comprised of a plurality of magnets fixedly mounted about an axis and a nonmagnetic cylindrical sleeve surrounding the magnets, has its lower portion immersed in developer mix in a developing tank. The developer mix is comprised of magnetic carrier particles and toner particles which are attracted to and adhere to each other due to triboelectric charging. The sleeve rotates about the magnets and, due to the magnetic attraction of the carrier particles to the magnets, developer mix is attracted to and adheres to the periphery of the sleeve to form a rotating magnetic brush. A doctor blade integral with the development tank limits the thickness of the magnetic brush. During development, the rotating magnetic brush is brought into contact with a photoconductive surface. Toner particles of a charge opposite that of an electrostatic latent image on the photoconductive surface are electrostatically attracted from the magnetic brush to the electrostatic image to form a toned image on the photoconductive surface. This toned image is transferred to a receiver sheet to which it is permanently fixed. During cleaning, a bias voltage is established between the magnetic brush and an electrode roller. This causes toner particles to be transferred from the magnetic brush to the electrode roller. The magnetic brush, then substantially depleted of toner particles, is able to clean residual toner particles from the photoconductive surface. Toner particles on the surface of the electrode roller are scraped off by a skive into a container.

A major problem with the Miyakawa et al apparatus is that during the cleaning step the nonmagnetic sleeve remains immersed in the developer mix and continues to pick up fresh developer mix. The electrode roller thus ends up "cleaning" a lot of toner from the magnetic brush that did not come from the photoconductive surface but rather, came from the fresh developer mix. This method of cleaning is inefficient and would not work well in a copier, such as the one disclosed in the DeBoer et al application, wherein a large amount of toner particles (not just residual toner) must be removed from a surface. A further problem with this apparatus is that toner particles removed from the electrode roller cannot be returned directly to the developing tank.

SUMMARY OF THE INVENTION

This invention is directed to an apparatus which can both lay down and pick up toner particles. In accordance with the invention, there is provided a magnetic brush laydown/pickup apparatus having a shell surrounding a plurality of alternating pole magnets, said shell and magnets being relatively movable to transport developer mix through a development zone. Developer mix, comprised of toner particles and carrier particles, is selectively supplied to the surface of the shell at a location upstream of a development zone. The developer mix is selectively removed from the surface of the shell at a location downstream of the development zone. Toner particles are selectively stripped from the developer mix on the shell. A control is used to (1) activate the supply and removal of developer mix to and from the shell and deactivate the stripping of toner particles to provide a source of toner particles for laydown in the development zone, and (2) deactivate the supply and removal of developer mix to and from the shell and activate the stripping of toner particles to provide a source of developer mix, substantially depleted of toner particles, for toner particle pickup in the development zone.

In a preferred embodiment of the invention, the stripping of the toner particles from the developer mix is accomplished by a toner control roller. A cleaning skive is provided for removing toner particles from the surface of the toner control roller. If the roller is rotated in one direction, the toner particles removed therefrom fall into a developer mix supply tank. If the roller is rotated in the opposite direction, the toner particles removed from the roller fall into a recovery bin for recycling or discard.

It is an advantage of this invention that the described magnetic brush laydown/pickup apparatus allows a large amount of toner to be applied to and removed from a surface. Because fresh developer mix is not supplied to the magnetic brush during the pickup step, all the toner that is removed from the magnetic brush is toner that was on the surface. There is no effort wasted removing toner from fresh developer mix that is supplied to the shell during cleaning as in the prior art apparatus. A further advantage of this invention is that the toner control roller performs the dual function of also metering the amount of developer mix on the shell.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings.

DETAILED DESCRIPTION OF THE BEST MODE

The magnetic brush laydown/pickup apparatus of the present invention will be described with reference to the image reproduction machine, described in the aforementioned U.S. patent application Ser. No. 621,691, in which a layer of toner particles is deposited on a receiver sheet having a thermoplastic outer layer. The toner particles are electrostatically attracted to the receiver sheet. The receiver sheet is imagewise exposed to a laser to selectively soften the thermoplastic layer. Toner particles adjacent the softened areas of the thermoplastic layer migrate into the layer by electrostatic attraction to the receiver sheet. Toner particles which do not migrate into the thermoplastic layer are removed to reveal a toner image. The magnetic brush laydown-/pickup apparatus of this invention is also useful in any copier/printer wherein one step involves applying toner to a surface and another step involves removing toner from such surface.

Figure 1:
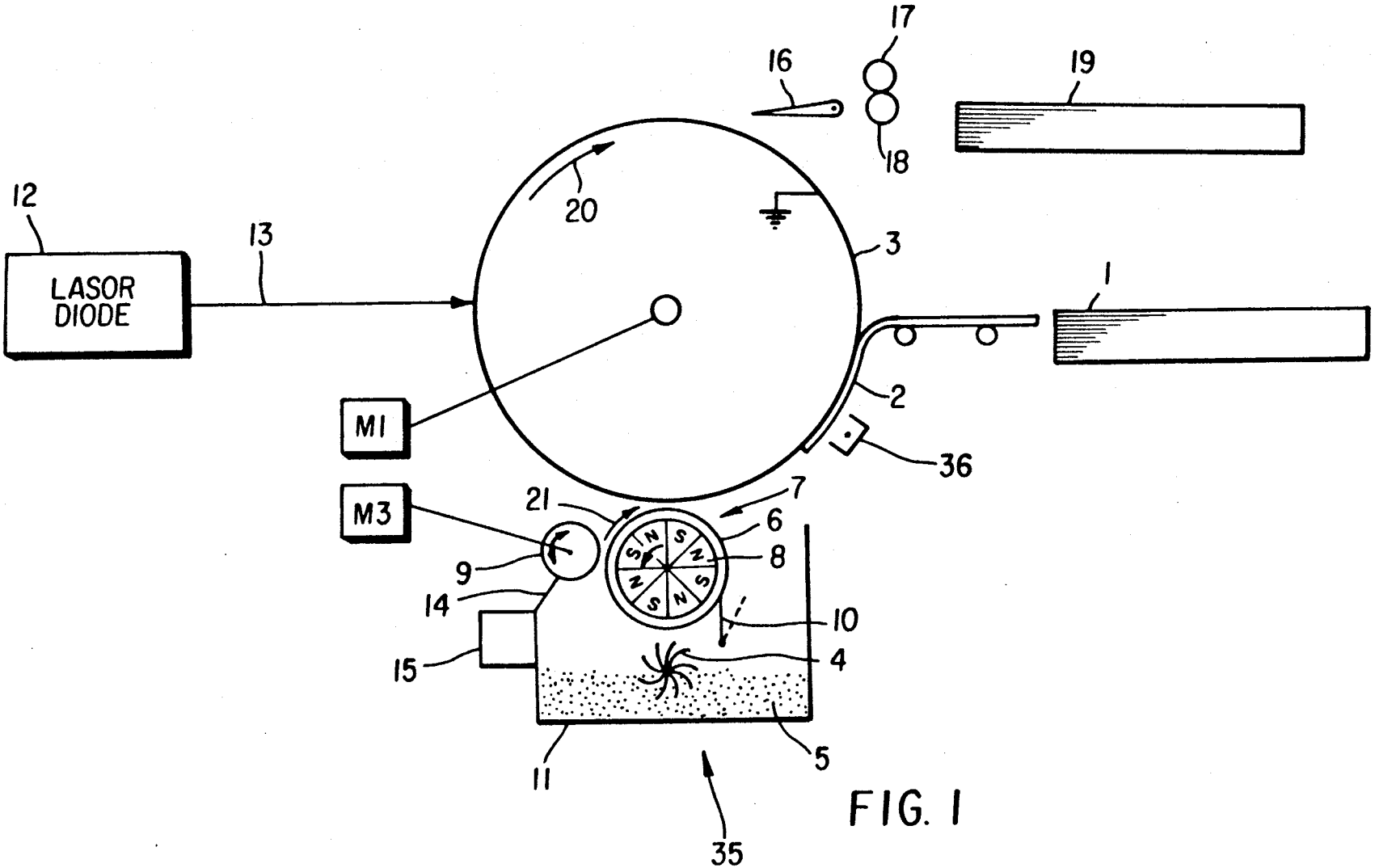
FIG. 1 is a side schematic view illustrating a copier/-printer including the magnetic brush laydown/pickup apparatus according to the present invention.

Turning now to FIG. 1, a copier/printer apparatus including the magnetic brush laydown/pickup apparatus of the present invention, designated generally by the numeral 35, is shown. A receiver sheet 2 is fed from a receiver sheet supply 1. Receiver sheet 2 has an outer layer of thermoplastic, such as poly-iso-butyl-methacrylate, a conductive layer and a support layer. Receiver sheet 2 is fed onto a process roller 3 and held there by conventional means, such as with the use of a vacuum made effective through small vacuum holes in the surface of process roller 3. The process roller has an outer grounded conductive layer. Process roller 3 is rotated in the direction of arrow 20 at a constant velocity, for example 10 cm/sec., by a motor M1.

Figure 2:
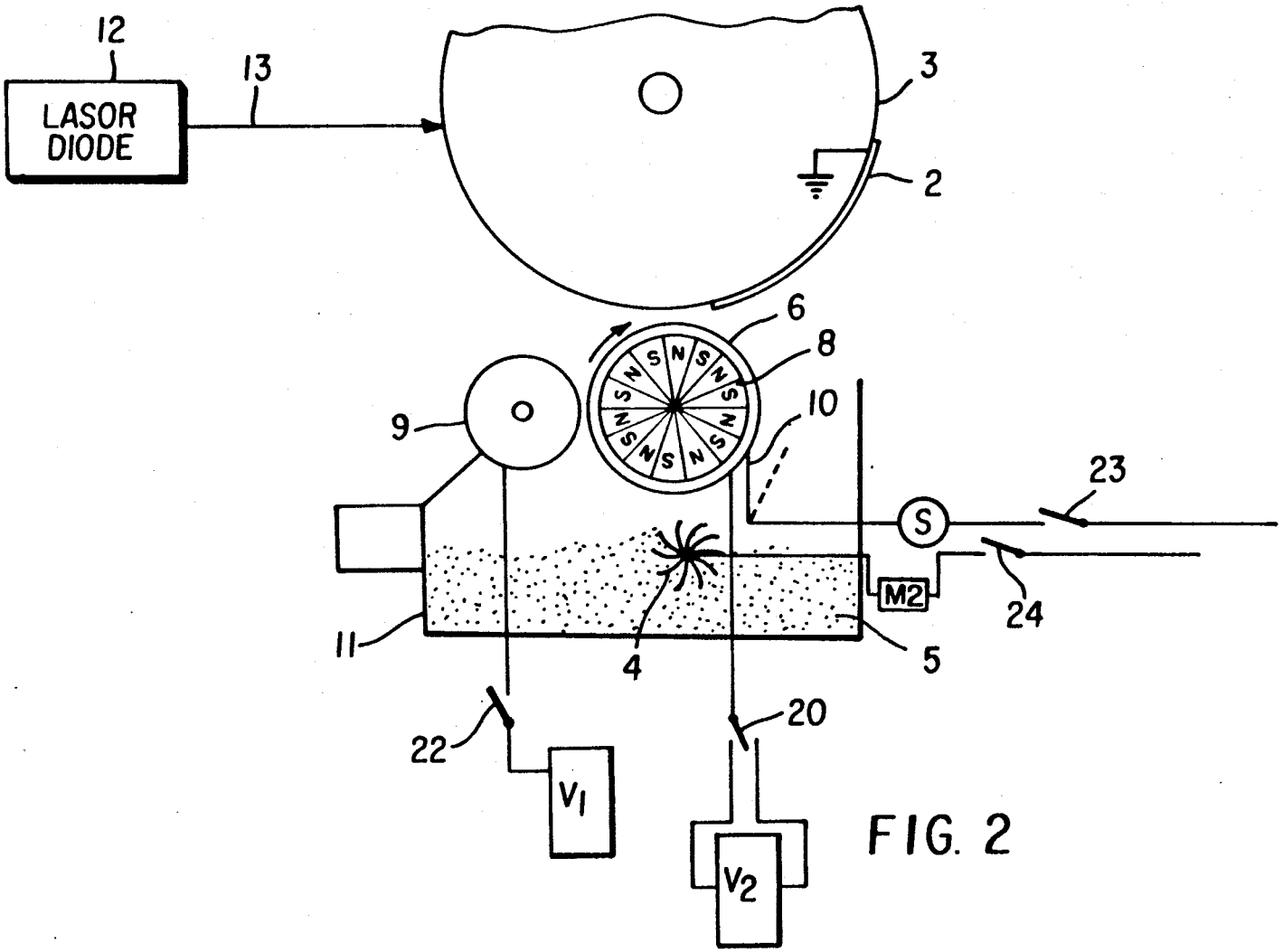
FIG. 2 is a side schematic view, on an enlarged scale, illustrating the magnetic brush laydown/pickup apparatus according to the present invention and the control for the apparatus.

In order to form a layer of toner (later used in image formation) on sheet 2, the magnetic brush laydown-/pickup apparatus 35, according to the present invention, is provided. The apparatus 35 includes a cylindrical shell 6 comprised of a nonmagnetic material; e.g., chrome, brass, aluminum, copper or stainless steel or a composite comprising a nonconductor, such as fibeglass, plated with one of the aforementioned materials. Developer mix 5 is comprised of magnetic carrier particles (in a preferred embodiment the particles have a coercivity greater than 200 oersteds) and toner particles which are attracted to the carrier particles due to triboelectric charging. Examples of appropriate carrier particles are barium ferrite and strontium ferrite. A series of alternating polarity magnets 8 are radially and rotatably mounted within shell 6. The magnets and shell are rotated by any of a number of devices well known in the art, such as a DC motor (not shown). Outer shell 6 is rotated in the direction of arrow 21 at a speed of preferably 5–50 rpm. The magnets 8 are rotated in the same or opposite direction at a speed of preferably 400–2500 rpm. The developer mix 5 adheres to shell 6 due to magnetic attraction of the carrier particles to magnets 8. During the toner laydown process, an auger 4 is rotated in a clockwise direction by a motor M2 which is engaged by closing a switch 24 (see FIG. 2). The auger supplies developer mix 5 to the surface of shell 6. The carrier particles on the outer surface of shell 6 flip, under the influence of the alternating polarity magnetic fields to which they are exposed, about the surface of shell 6. Of course, it is suitable for use with this invention to maintain the shell stationary and rotate the magnets so as to cause the developer mix to move about the surface of the shell.

A toner control roller 9 is located downstream of auger 4 proximate shell 6. Toner control roller 9 has an electrically conductive layer which is connected to a voltage supply V1 shown in FIG. 2. A voltage supply V2 is connected to shell 6. The toner control roller 9, which may be stationary or rotated in either direction by a reversible motor M3, is spaced a preselected distance from the surface of the shell 6 to meter the nap of developer mix 5 on the surface of shell 6.

Figure 3:
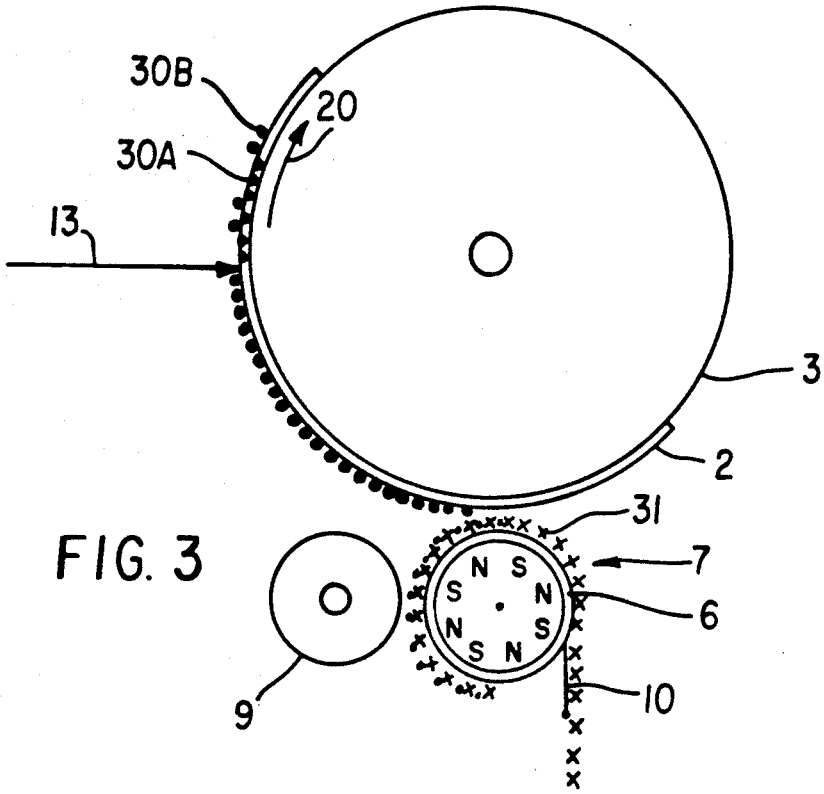
FIG. 3 is a side schematic view illustrating the magnetic brush laydown/pickup apparatus operating in a toner laydown mode.

Just after the leading edge of receiver sheet 2 enters a development zone at the interface between process roller 3 and shell 6, a bias voltage of a polarity the same as that of the triboelectric charge on the toner particle is applied to shell 6 by voltage supply V2. This is accomplished by closing a switch 20 (rotating switch clockwise in FIG. 2). The conductive layer in receiving sheet 2 is maintained at ground potential, creating an electric field between the receiver sheet and the shell. This electric field must be strong enough to overcome the triboelectric attraction of the toner and carrier particles to each other. The bias voltage placed on shell 6 is preferably between 100 and 500 volts. The toner particles, under the influence of the electric field, leave the surface of the shell and adhere to the surface of the receiver sheet in a uniform layer (see FIG. 3). The carrier particles have a triboelectric charge opposite that on the toner particles, causing the carrier particles to remain on the shell. A take-off skive 10 (retained in its solid line position shown in FIGS. 1 and 2), located downstream of the development zone, removes developer mix 5, substantially depleted of toner, from the surface of shell 6. The depleted developer mix falls back into a developer mix supply tank 11 where it is replenished with toner particles. Just prior to the trailing edge of receiver sheet 2 passing the interface between process roller 3 and shell 6, the bias voltage on shell 6 is turned off by rotating switch 20 counter-clockwise to an open position, ending the transfer of toner particles from shell 6. The toner particles already on receiver sheet 2 remain there firmly due to electrostatic attraction to the grounded conductive layer of receiver sheet 2 and surface forces.

Receiver sheet 2, with the layer of toner particles on the surface, approaches a laser diode 12. Laser diode 12 emits a laser beam 13 which scans across the receiver sheet 2 in a direction essentially parallel to the axis of rotation of process roller 3. The laser beam is focused on the toner particle layer. As laser beam 13 scans across the receiver sheet, it is intensity modulated in a manner in which the intensity of the beam corresponds to image information to be reproduced. When toner particles 30A are exposed to laser beam 13 in a high intensity state, such particles are heated (see FIG. 3). The heated toner particles 30A soften the adjacent thermoplastic, allowing such toner particles to penetrate the softened thermoplastic under the influence of their electrostatic attraction to the grounded conductive layer of process roller 3. Additionally, the heated toner particles 30A partially tack to each other. Toner particles 30B, which are exposed to the laser beam in its low intensity state, are not heated and therefore do not soften the thermoplastic layer. Accordingly, such non-heated particles cannot penetrate the thermoplastic layer because the thermoplastic remains hard.

After exposure of the receiver sheet 2, such sheet remains on the rotating process roller 3. As such, receiver sheet 2 again approaches magnetic brush 7. An AC corona charger 36, located immediately upstream in the direction of sheet travel, reduces any charge remaining on the receiver sheet. This facilitates the removal of toner particles 30B which have not penetrated the thermoplastic layer.

Figure 4:
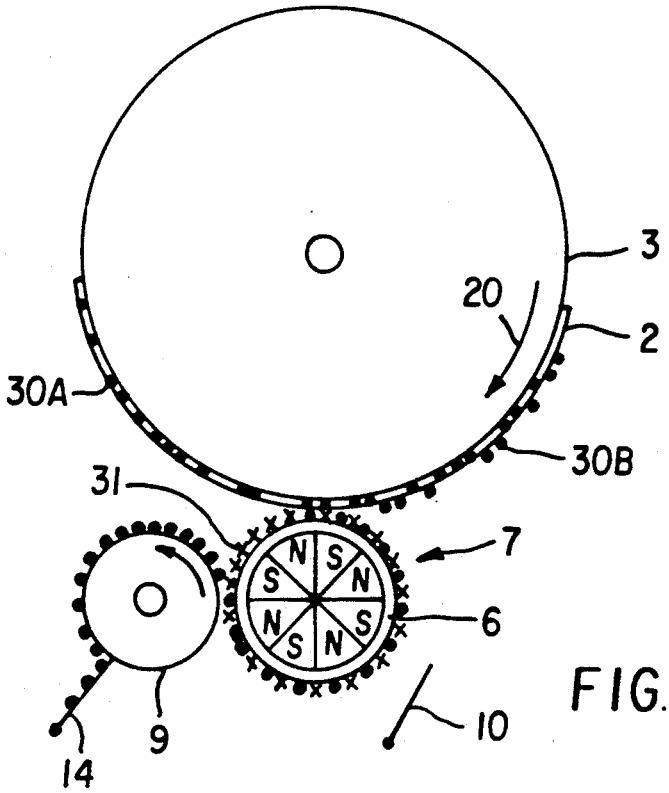
FIG. 4 is a side schematic view illustrating the magnetic brush laydown/pickup apparatus operating in a toner pickup mode.

Prior to receiver sheet 2 reaching the interface of process roller 3 and magnetic brush 7, the magnetic brush laydown/pickup apparatus 35 is set to operate in its toner pickup mode (see FIG. 4). Take-off skive 10 is rotated clockwise to its solid line position by a solenoid S which is engaged by closing a switch 23. (When it is desired to return the skive into contact with the shell, switch 23 is opened, disengaging the solenoid and allowing a solenoid return spring to rotate the skive counter-clockwise.) This disengages the skive from the surface of shell 6, allowing a nap of developer mix to remain on the surface of the shell. Rotation of auger 4 is stopped by opening switch 24 which disengages motor M2. This discontinues the supply of fresh developer mix 5 to shell 6. A bias voltage of a polarity opposite that on the toner particles, and of a magnitude of preferably between 25 and 100 volts is applied to shell 6 by closing switch 20 (rotating it counter-clockwise). A voltage of the same polarity as that voltage on the shell and of a magnitude of preferably between 100 and 900 volts is applied to the conductive layer of toner control roller 9 by closing a switch 22. The resulting electric field between toner control roller 9 and shell 6 is sufficient to attract toner particles from the developer mix 5 on the surface of shell 6 to the surface of toner control roller 9. For example, if the toner particles had a positive charge due to triboelectric charging, a charge of −100 V could be placed on shell 6, and a charge of −800 V could be applied to toner controller roller 9.

Toner control roller 9 is rotated in either a clockwise or counter-clockwise direction by motor M3. The toner particles on the surface of toner control roller 9 are stripped therefrom by a cleaning skive 14. When toner control roller 9 is rotated in a clockwise direction, stripped toner is returned directly to supply tank 11. When toner control roller 9 is rotated counter-clockwise, toner is stripped from the surface of toner control roller 9 and falls into a recovery bin 15 for discard or recycling. Such discarding of toner may be required in certain applications if there is a concern that reclaimed toner may contaminate developer mix 5.

By the time receiver sheet 2 reaches the interface between process roller 3 and shell 6, the developer mix remaining on the surface of shell 6 has been substantially stripped of toner particles by the toner roller 9, leaving primarily carrier particles 31 on the shell. As receiver sheet 2 passes by magnetic brush 7, it is contacted by the nap of carrier particles 31. The tumbling action of the carrier particles overcomes the surface forces holding toner particles 30B on the surface of receiver sheet 2. The cleaning action of magnetic brush 7 is thorough enough to remove toner particles 30B, yet gentle enough not to remove toner particles 30A imbedded in the thermoplastic layer of the receiver sheet. The electric field between shell 6 and the grounded conductive layer of receiver sheet 2, as well as triboelectric forces, causes toner particles 30B to be transferred to the carrier particles on the surface of shell 6. Toner particles 30B (adhering to the carrier particles) are carried by the shell past skive 10 to roller 9. Toner control roller 9 strips toner particles 30B from the carrier particles before the carrier particles are returned to the interface to remove further toner particles 30B from receiver sheet 2. Accordingly, a large quantity of toner particles 30B may be removed from receiver sheet 2 without an excessive buildup of toner particles on the surface of shell 6. Upon completion of toner removal, take-off skive 10 is rotated back into engagement with shell 6 to remove toner depleted developer mix from the shell. This developer mix falls back into supply tank 11 where it is replenished with toner particles in preparation for the next toner laydown sequence.

Receiver sheet 2, after having toner particles 30B removed therefrom (leaving toner particles 30A in a toned imagewise pattern thereon), is rotated with process roller 3 to a pick-off blade 16 which is rotated by a solenoid (not shown) to engage the surface of process roller 3 and remove receiver sheet 2 therefrom. Receiver sheet 2 is then directed through a nip formed by a fusing roller 17 and a backing roller 18, where heat is applied by fusing roller 17 to permanently fuse the tone image onto receiver sheet 2. The rollers draw the receiver sheet through the nip. Receiver sheet 2 is thereafter deposited into an exit hopper 19.

Although the invention has been described in considerable detail with particular reference to a preferred embodiment thereof, variations and modifications can be effected within the spirit and scope of the invention.

We claim:

1. A magnetic brush laydown/pickup apparatus having a shell surrounding a plurality of alternating pole magnets, said shell and magnets being relatively movable to transport developer mix through a development zone, said apparatus comprising:

means, located upstream of the development zone relative to a direction of transport of said developer mix, for selectively supplying developer mix, including toner particles and carrier particles, to the surface of said shell;

means, located downstream of the development zone relative to a direction of transport of said developer mix, for selectively removing developer mix from the surface of said shell;

means, located proximate said shell, for selectively stripping toner particles from said developer mix on said shell; and control means for (1) activating said supply means and removing means and deactivating said stripping means to provide a source of toner particles for laydown in the development zone, and (2) deactivating said supply means and said removing means and activating said stripping means to provide a source of substantially toner particle depleted developer mix for toner particle pickup in the development zone.

2. The magnetic brush laydown/pickup apparatus of claim 1 wherein said stripping means is located downstream of said supply means and upstream of said development zone, and wherein the proximity of said stripping means to said shell is such that said stripping means meters the amount of developer mix on said shell.

3. The magnetic brush laydown/pickup apparatus of claim 2 wherein said stripping means comprises a rotatably mounted toner control roller.

4. The magnetic brush laydown/pickup apparatus of claim 3 further comprising a second removing means for removing toner particles from the surface of said toner control roller.

5. The magnetic brush laydown/pickup apparatus of claim 4 wherein said second removing means comprises a cleaning skive engaging the surface of said toner control roller.

6. The magnetic brush laydown/pickup apparatus of claim 5 wherein said supplying means includes a developer mix supply tank, and wherein said toner control roller, located in association with said supply tank, is rotated relative to said cleaning skive such that said cleaning skive causes toner particles removed from the surface of said toner control roller to return to said developer mix supply tank.

7. The magnetic brush laydown/pickup apparatus of claim 5 further comprising a recovery bin, and wherein said toner control roller, located in association with said recovery bin, is rotated relative to said cleaning skive such that said cleaning skive causes toner particles removed from the surface of said toner control roller to pass to the recovery bin.

8. The magnetic brush laydown/pickup apparatus of claim 5 further comprising a recovery bin, wherein said supplying means includes a developer mix supply tank, and wherein when said toner control roller, located in association with said supply tank and said recovery bin, is rotated, relative to said cleaning skive, in one direction, said cleaning skive causes toner particles removed from the surface of said toner control roller to return to said developer mix supply tank, and when said toner control roller is rotated in the opposite direction, said cleaning skive causes toner particles removed from said toner control roller to fall into said recovery bin.

9. The magnetic brush laydown/pickup apparatus of claim 1 wherein said removing means comprises a take-off skive pivotable to a first position engaging said shell for removing developer mix from said shell and to a second position remote from said shell for allowing developer mix to remain on said shell.

10. A method of selectively laying down or picking up toner particles in a development zone with a magnetic brush, said magnetic brush having a shell surrounding a plurality of alternating pole magnets, said shell and magnets being relatively movable to transport developer mix through the development zone, the method comprising the steps of:

a) selectively supplying developer mix, including toner particles and carrier particles, to the surface of the shell at a location on the shell upstream of the development zone relative to a direction of transport of said developer mix;

b) selectively removing developer mix from the surface of the shell at a location on the shell downstream of the development zone relative to a direction of transport of said developer mix;

c) selectively stripping toner particles from the developer mix on the surface of the shell;

d) providing a source of toner particles for laydown in the development zone by causing developer mix to be supplied to the shell; and e) providing a source of substantially toner particle depleted developer mix for toner particle pickup in the development zone by preventing the removal of developer mix from the shell, preventing the supply of developer mix to the shell and causing toner particles to be stripped from the developer mix on the shell.

11. A method of selectively laying down or picking up toner particles in a development zone as defined in claim 10, further comprising the step of returning the stripped toner particles to a location where they can be remixed with said developer mix.

* * * * *